US008763493B2

(12) United States Patent
Currier et al.

(10) Patent No.: US 8,763,493 B2
(45) Date of Patent: Jul. 1, 2014

(54) KNOB RETENTION

(75) Inventors: Richard S. Currier, Rochester, NY (US); David Cipolla, Macedon, NY (US); Jose Ricardo Duran, Williamson, NY (US); Jason Scott, W. Henrietta, NY (US)

(73) Assignee: Harris Corporation, Melbourne, FL (US)

( * ) Notice: Subject to any disclaimer, the term of this patent is extended or adjusted under 35 U.S.C. 154(b) by 89 days.

(21) Appl. No.: 13/567,349

(22) Filed: Aug. 6, 2012

(65) Prior Publication Data

US 2014/0033857 A1 Feb. 6, 2014

(51) Int. Cl.
*G05G 1/10* (2006.01)

(52) U.S. Cl.
USPC ..... 74/553

(58) Field of Classification Search
USPC ..... 74/10 R, 504, 553, 558; 16/441; 403/373; 411/221, 429
See application file for complete search history.

(56) References Cited

U.S. PATENT DOCUMENTS

| | | | | | |
|---|---|---|---|---|---|
| 3,074,292 | A | * | 1/1963 | Polmon | 74/553 |
| 3,353,580 | A | * | 11/1967 | Benjamin | 411/303 |
| 4,201,096 | A | * | 5/1980 | Morrison et al. | 74/531 |
| 4,347,758 | A | * | 9/1982 | Geil et al. | 74/531 |
| 4,487,089 | A | * | 12/1984 | Harwood | 74/531 |
| 4,710,082 | A | * | 12/1987 | Curtis | 411/373 |
| 4,779,305 | A | * | 10/1988 | Gorsek | 16/441 |
| 4,993,280 | A | | 2/1991 | Olkoski et al. | |
| 7,555,821 | B2 | * | 7/2009 | Thomeczek et al. | 29/525.01 |

* cited by examiner

*Primary Examiner* — Vicky Johnson
(74) *Attorney, Agent, or Firm* — Fox Rothschild, LLP; Robert J. Sacco

(57) ABSTRACT

A user control knob retention system includes a nut (20) which has a base (25). The base includes two opposing nut end faces (23*a*, 23*b*), and a threaded bore (21) aligned with a base central axis (29). A wall (27) extends transversely from a first one of the nut end faces. The wall defines an inner surface (42) which comprises a circular arc coaxial with the central axis. The wall extends at least partially around a circumference of the base to define a capture space (26). An insert (30) rotatably retained within the capture space includes a body having a cylindrical shape. A retention barb (34) disposed on an outer cylindrical surface of the insert is configured for engaging an interlocking element (54) formed on an interior bore (58) of a user control knob (50).

12 Claims, 6 Drawing Sheets

KNOB RETENTION

BACKGROUND OF THE INVENTION

1. Statement of the Technical Field

The inventive arrangements relate to user control knobs which are mounted on rotatable control shafts, and more particularly to methods and systems for retaining user control knobs in position on rotatable control shafts.

2. Description of the Related Art

Many devices, including electronic devices, utilize manually operated rotatable control elements. These control elements include a shaft which rotates for purposes of actuating an electronic or manual control. Conventional shafts have a D-shaped cross-sectional profile. The D-shaped cross-sectional profile includes a planar face on a portion of the shaft which facilitates indexing of the knob in the proper orientation on the shaft. The D-shaped profile is also useful because it prevents rotation of knob relative to the shaft. A retention system is often provided to secure the knob on the shaft. A common retention system comprises a set screw threaded into the knob. The set screw engages the shaft to prevent the knob from sliding off the shaft.

Knob retention systems that use set screws can, under certain circumstances, permit control knobs to slide off the shaft and become lost. Most often, such loss occurs when the set screws become loose and/or the electronic device is accidentally dropped. These kinds of failures are undesirable, especially for equipment used by first responders or military operators. In order to overcome these limitations, designers have developed alternative knob retention solutions. For example, one such solution uses specialized knob inserts and customized control shafts in which special grooves have been provided. The insert is designed to snap into the groove. The control is then secured into the housing of the electronic device. Finally, a knob is snapped onto the insert.

Existing solutions which overcome the set-screw problem are not entirely satisfactory. The required customization of control shafts generally tends to increase component costs since these custom features are not normally included in commercial control shafts. Another problem with existing solutions is that the normal axial play which is present in rotatable controls tends to inhibit proper assembly of knobs onto the inserts. In other words, the shafts tend to rotate as the insert is being snapped into the specialized grooves formed on the shafts. When the knob must be removed from the electronic device, the shafts are sometimes damaged or can be pulled out of the control, due to the axial forces which must be applied during knob removal. Also, knob inserts sometimes become lodged within the knobs, and damage can occur to such inserts during knob removal.

SUMMARY OF THE INVENTION

Embodiments of the invention concern a knob retention system. The system comprises a nut which includes a base. The base has a generally cylindrical shape including two opposing nut end faces and a threaded bore aligned with a base central axis. A wall extends from a first one of the nut end faces in a direction parallel to the central axis. The wall defines an inner surface which forms a circular arc coaxial with the central axis. The wall extends less than an entire circumference around the base to define a capture space. An insert is rotatably retained within the capture space by the wall. The insert includes a body having a cylindrical shape, a retention barb disposed on an outer cylindrical surface of the insert configured for engaging an interlocking element formed on an interior bore of a user control knob, and a D-shaped bore extending along an insert central axis. A user control knob has an interior bore aligned with the base central axis and the insert central axis. The interior bore has an inner profile adapted for receiving the nut and the insert therein, and includes an interior wall which defines an interlocking element for engaging the retention barb. The threaded bore of the nut is configured to engage a plurality of threads provided on a collar of a control element, and the D-shaped bore is configured to receive a rotatable shaft of the control element.

The invention also concerns a method for retaining a knob on a rotatable shaft of a control element. The method includes positioning a cylindrically shaped insert within a capture space provided on a first end face of a nut. This step involves aligning a central D-shaped bore of the insert with a central axis defined by a threaded bore of the nut. The method continues by facilitating rotational displacement of the insert within the capture space using an inner bearing surface formed of a wall. The wall projects transversely from the first end face and extends at least partially around a circumference of the nut to define a circular arc coaxial with the central axis. The method continues with inserting a rotatable shaft of a control element through threaded bore and the D-shaped bore. The nut is threaded onto a collar of the control element coaxial with the rotatable shaft. The insert is then urged into a bore of a control knob which has an inner profile adapted for receiving the insert therein. A barb formed on the insert is engaged by an interlocking element formed on an interior wall of the bore to secure the control knob on the rotatable shaft.

BRIEF DESCRIPTION OF THE DRAWINGS

Embodiments will be described with reference to the following drawing figures, in which like numerals represent like items throughout the figures, and in which.

DETAILED DESCRIPTION

Figure 1:
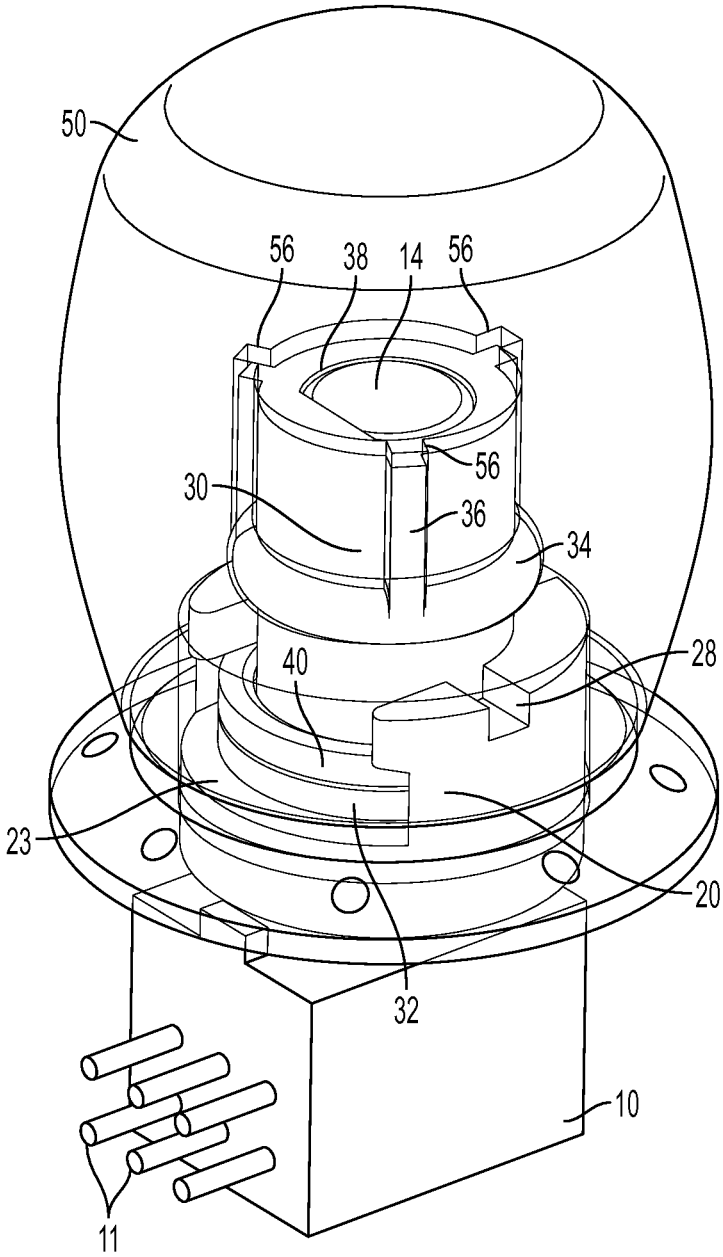
FIG. 1 is a perspective view showing an assembly which is useful for understanding the invention, in which a knob retention system is used to secure a knob on a control element.

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. Though preferred materials are detailed for manufacture of certain elements, the invention is not limited in this regard and other materials can also be used for the indicated element. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

The invention concerns a user control knob retention system. A perspective view of the retention system is shown in FIG. 1, installed on a control element 10. The control element 10 is a conventional design comprising a control housing 18 which encloses a circuit device (not show). The circuit device can be any of a variety of well known circuit devices that are designed to be axially rotated for purposes of controlling a piece of equipment, such as a portable electronic device. As such, the circuit device can be a rotary switch, encoder, potentiometer, or rheostat without limitation. A plurality of pins 11 conventionally extend through the housing 18 for purposes of forming electrical contacts with the circuit device. The pins are most commonly attached to a printed wiring board or the rigid or flexible variety. A rotatable shaft 14 is commonly used to actuate the circuit device. The shaft extends into the housing and is coaxial with a collar 12. The collar 12 is generally threaded to accommodate a retention nut.

Figure 2:
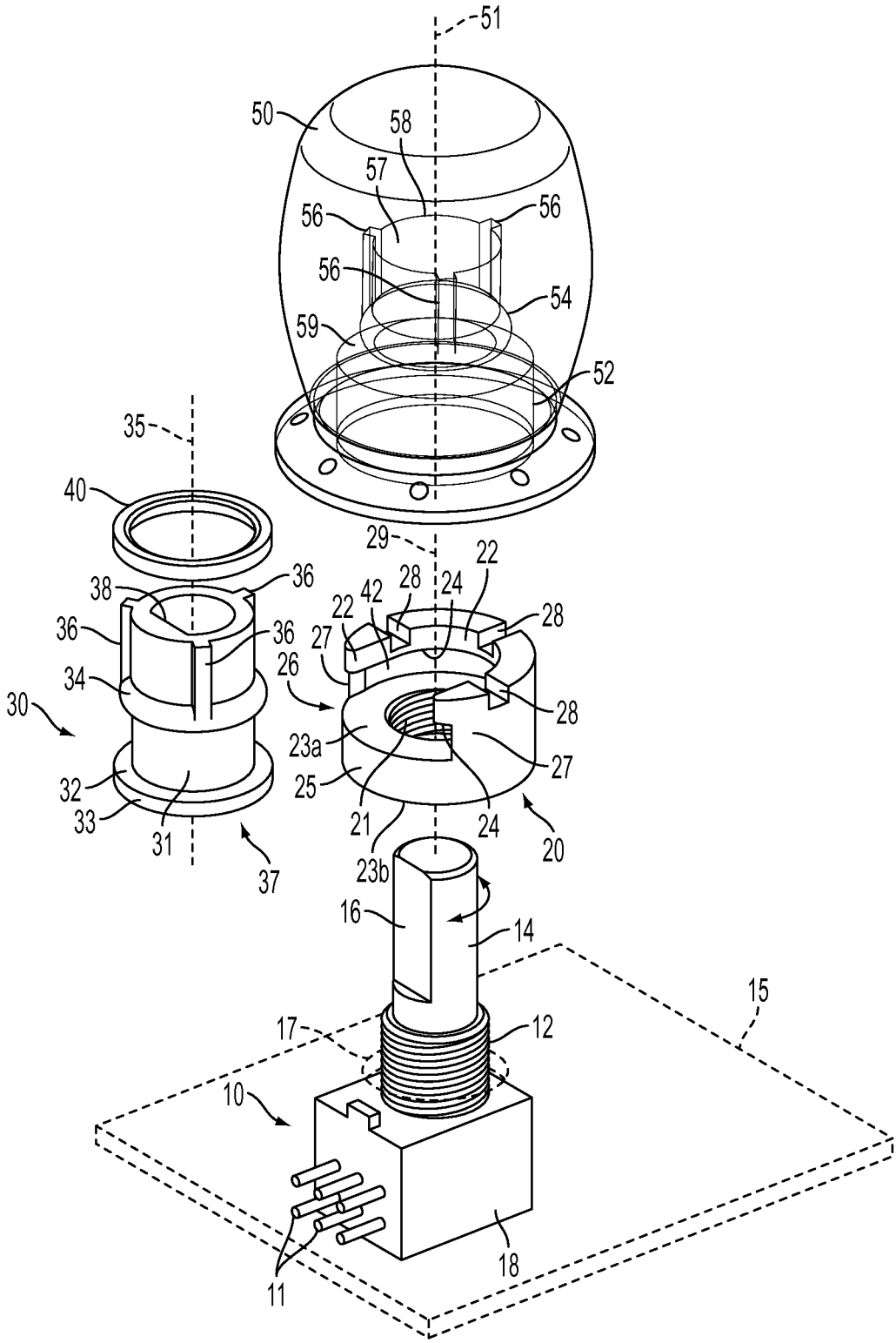
FIG. 2 is an exploded view of the knob retention system in FIG. 1.

The control element 10 is conventionally secured to a portable electronic device by inserting the shaft and collar through an opening 17 formed in a wall 15 of a case. As shown in FIG. 2, the housing 18 is normally retained inside the case of the portable electronic device while the collar and shaft extend outside. A retention nut is commonly threaded onto the collar 12 and secures the control element in the opening of the case wall. In conventional arrangements, a knob is provided on the shaft 14 to facilitated actuation of the control element. Commercial off-the-shelf control elements commonly have a shaft 14 which include a substantially planar shaft face 16. The remainder of the shaft can have a cylindrical or rounded profile such that the shaft overall has D-shaped cross-sectional profile. The control knob will often have an internal passage with a complimentary D-shaped profile for receiving the shaft 14. The D-shaped profile facilitates alignment of the control knob on the shaft and prevents the knob from slipping on the shaft as the knob is rotated.

The retention system of the present invention includes a nut 20 (sometimes referred to herein as a retention nut) which is configured to secure the control element 10 within an opening 17 formed in a case wall 15 of an electronic device. The nut preferably has a generally cylindrical outer shape as shown. As used herein, the phrase "cylindrical shape" is intended to include nuts that have a round outer profile as shown. However, this phrase can also potentially include nuts that have other outer profile shapes without limitation. For example, the outer surface of the nut can have several facets, provided that such shapes do not interfere with rotation of the nut within an interior of a control knob as hereinafter described.

The nut 20 includes a threaded bore 21 which extends through a base 25 in alignment with a base central axis 29. The base 25 also has two opposing nut end faces 23*a*, 23*b*. A nut wall 27 extends transversely from a first one of the nut end faces 23*a* to an upper portion 22, in a direction which is generally aligned with the base central axis 29. One or more notches 28 are advantageously provided along the upper portion 22 so that an upper portion of the nut has a castellated feature. The notches associated with the castellated feature are advantageously configured to receive a bit of a tool. As such, the notches can be advantageously configured to facilitate threading of the nut onto the collar 12.

The nut wall 27 defines an inner surface 42 which comprises a substantially circular arc coaxial with the base central axis 29. It can be observed in FIG. 2 that the wall extends partially around a periphery or circumference of the base 25 to define a capture space 26. In a preferred embodiment, the nut wall can have a U-shaped configuration which includes a gap formed in the wall to facilitate insertion of an insert 30 within the capture space 26. The nut can be formed of any suitable material. For example, the nut can be formed of a metal or polymer material having sufficient rigidity to secure the control element on within the opening 17. The nut can be formed by casting, machining or other suitable means.

Referring now to FIGS. 1-4, an insert 30 is rotatably retained within the capture space 26 by an inner surface 42 and a lip 24. The insert includes a body 31 having a generally cylindrical shape. The insert includes a D-shaped bore which extends through the body 31 along a central axis 35. The D-shaped bore is sized and shaped for snug engagement with the D-shaped shaft 14 of the control element 10. The insert also includes a flange 32. The flange serves as a bushing configured to facilitate rotational engagement of the insert within the capture space 26 of the nut. More particularly, the flange has a circular profile defined by an outer cylindrical face 33. The outer cylindrical face 33 is snugly fitted within the inner surface 42 of wall 27 to facilitate rotation of the insert 30 relative to the nut 20 when the insert is present in the capture space and the central axis 35 of the insert is aligned with a central axis 29 of the nut. Similarly, a surface of insert end face 37 is configured to rotatably engage the nut end face 23*a* when the insert is retained within the capture space.

The insert can be formed of the same or a different material as compared to the retention nut 20. For example, the insert can be formed of a metal or polymer material having sufficient rigidity to facilitate securing of a user control knob to the retention system. The insert can be formed by casting, machining or other suitable means.

In some applications, it can be desirable to increase or decrease an amount of resistance associated with the rotation a control element shaft 14. Accordingly, a friction control disk 40 is optionally included in the retention system for selectively increasing or reducing an amount of friction associated with the rotation of the insert 30 within the capture space 26. The friction control disk is advantageously disposed between the flange 32 and the lip 24. This arrangement is best understood with reference to FIGS. 1 and 3. In a preferred embodiment, the friction control disk is fitted snugly between the flange and the lip so that the disk provides a predetermined amount of resistance to rotation of the insert relative to the nut. In order to achieve a desired amount of friction, the friction control disk 40 can be formed of a metal, rubber, polymer or silicone material as appropriate to provide a desired resistance associated with rotation of the shaft 14. In an alternative embodiment, the friction control disk can be disposed between the flange 32 and the nut end face 23*a*.

The insert includes a retention barb 34 disposed on an outer cylindrical surface of the insert. The retention barb is configured for engaging an interlocking element 54 which is formed on an interior bore 58 of a user control knob. For example, the interlocking element can be an indent formed on the interior bore 58. In such embodiment, the retention barb can be formed as a raised element extending partially or completely around a periphery of the cylindrical body 33. The raised element can have a profile which in cross-section forms a ridge, nub, bump or other feature configured for engaging an interior of a bore 58 formed in a user control knob 50. In an alternative embodiment shown in FIG. 5, the retention barb can be formed as an indented portion extending partially or completely around a periphery of the insert, and configured to engage an interlocking element 54 which is formed as a nub, bump or ridge disposed on the interior bore of a user control knob.

Figure 3:
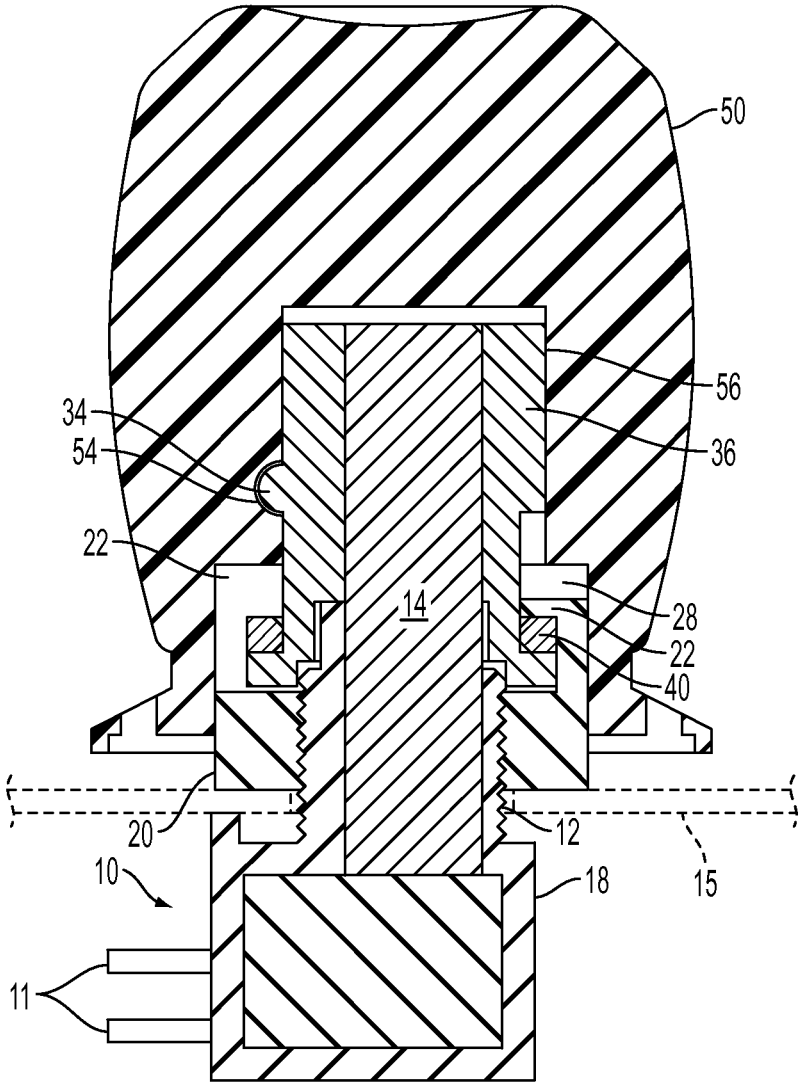
FIG. 3 is a cross-sectional view of the knob retention system in FIG. 1, taken along line 3-3.
Figure 4:
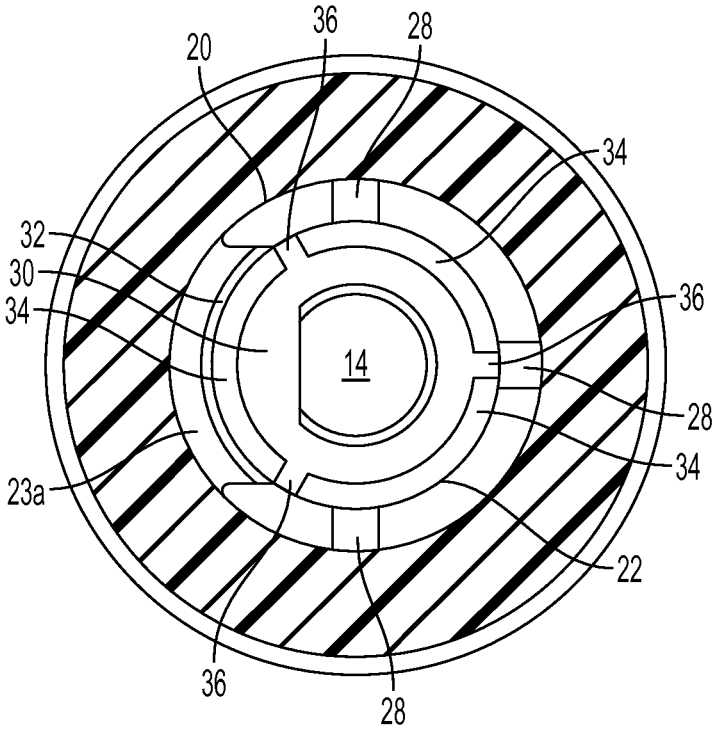
FIG. 4 is a top view of the assembly in FIG. 1 in which a portion of a knob element has been cut away to reveal the knob retention system.

The knob retention system further includes a user control knob 50 having an interior bore 58. The insert 30 and nut 20 are positioned within the user control knob as shown in FIGS. 1 and 3-4. More particularly, the user control knob 50 is disposed so that a central axis 51 of the user control knob is generally aligned with the base central axis 29 and the insert central axis 35. The interior bore 58 is defined by an interior wall 59 which has an inner profile adapted for receiving the nut 20 and the insert 30 therein. As such the inner bore can include a nut cavity 52 and an insert cavity 57. The nut cavity 52 has a shape which is sized and shaped for receiving the body of the nut 20 therein. More particularly, the nut cavity is sized and shaped to allow the body of the nut to be received within the cavity and to allow the user control knob to rotate around the body of the nut 20 when the nut is secured to the collar 12.

Figure 5:
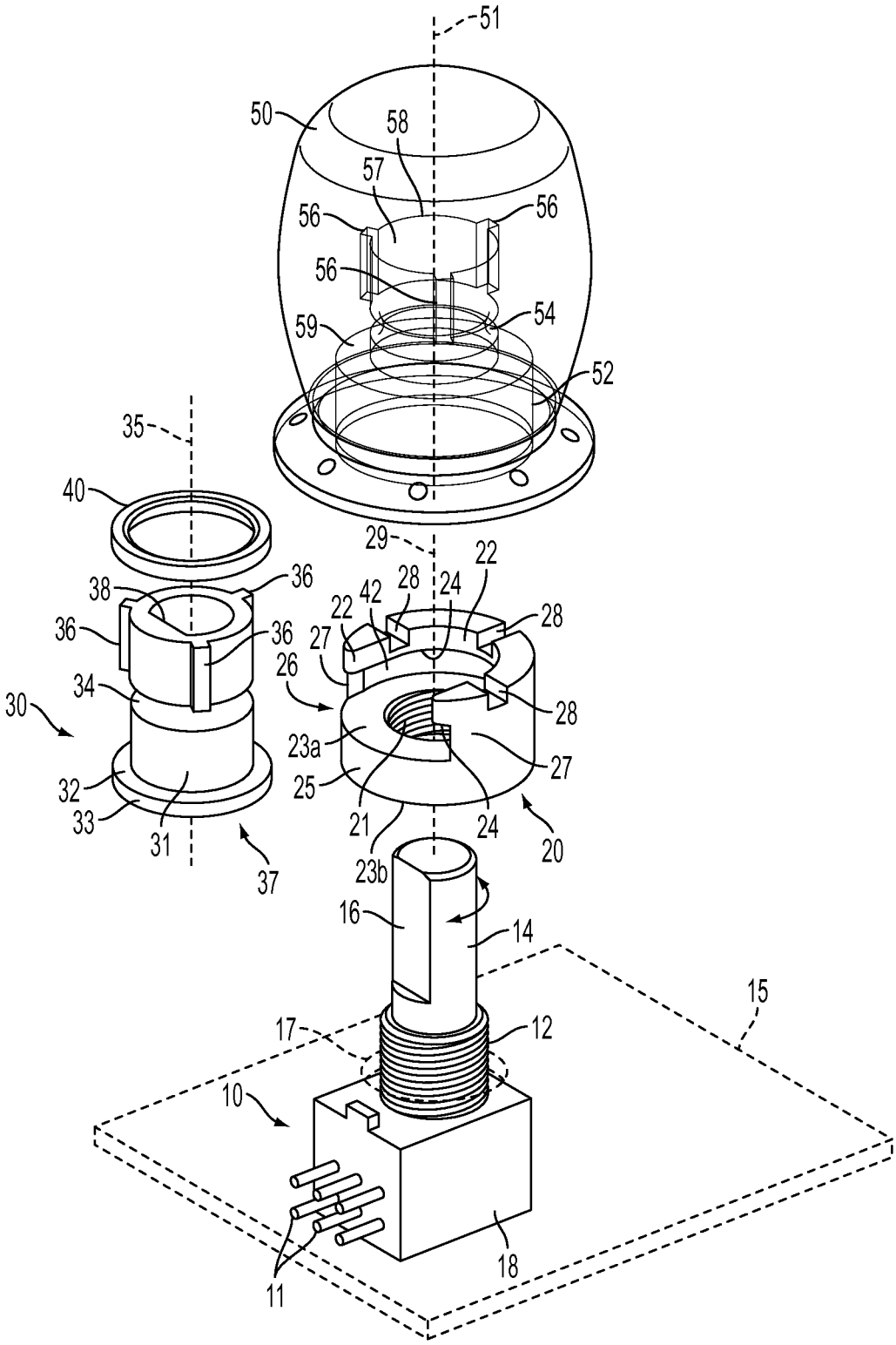
FIG. 5 is an exploded view showing an alternative embodiment of the invention.
Figure 6:
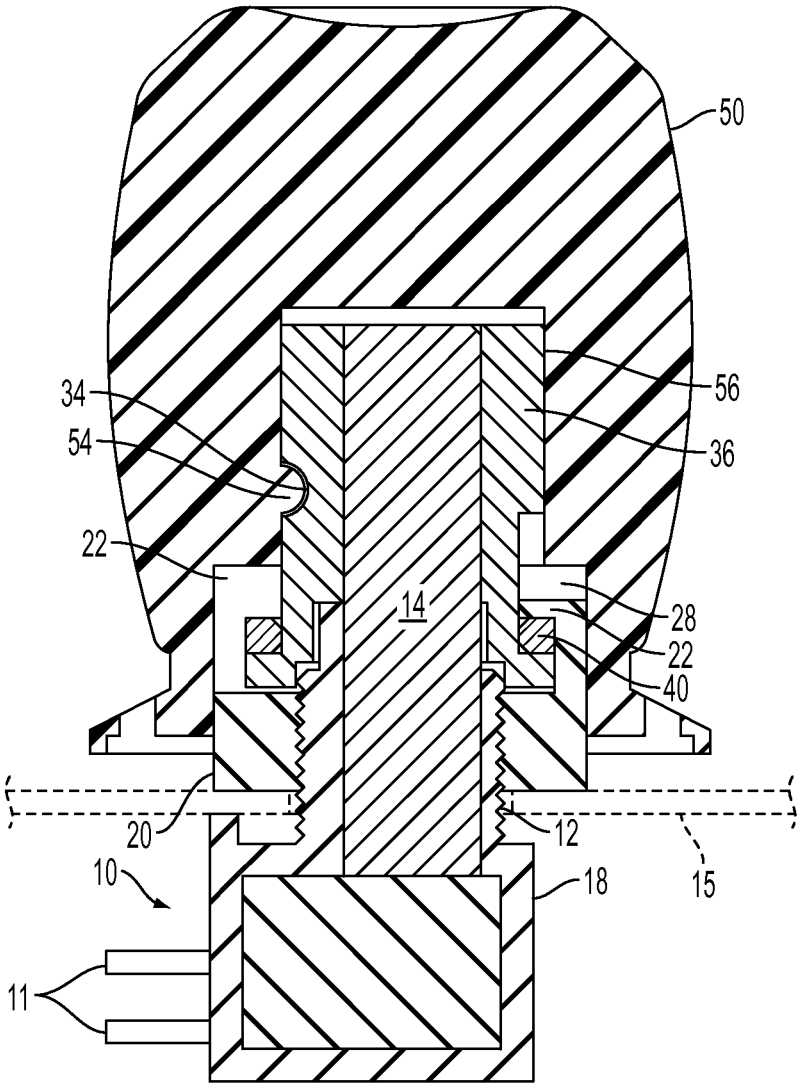
FIG. 6 is a cross-sectional view showing the alternative embodiment of FIG. 5.

The insert cavity 57 is configured to snugly receive the insert therein and to removably secure the user control knob to the insert. As such, the insert cavity 57 includes an interlocking element 54 that is shaped to engage the retention barb of the insert therein. The interlocking element 54 is configured to engage retention barb 34 in a snap-lock engagement so that the user control knob is securely attached to the insert, but can be removed when sufficient axial force is exerted upon the user control knob. Of course, for those embodiments where the retention barb 34 is comprised of an indent in the cylindrical body of the insert (instead of a projection, bump or nub) then an interlocking element 54 would not be an indented surface, but would instead be replaced by an appropriate nub or projection formed on the interior bore of the user control knob. Such an arrangement is illustrated in FIG. 5.

The insert 30 can optionally include one or more orientation flukes 36 that are generally aligned with the insert central axis 51 as shown. For example, these orientation flukes can be disposed on an outer surface of the insert 30 as show. The orientation flukes 36 are advantageously arranged so that they can be aligned with one or more slots 56 disposed on the interior bore of the user control knob 50, when the user control knob is properly oriented relative to the insert. The orientation flukes are preferably arranged in an asymmetrical pattern on the periphery of the insert so that they will align with the slots 56 only when the control knob 50 is in a predetermined orientation relative to the insert. Moreover, the orientation flukes advantageously have a predetermined orientation relative to the D-shaped bore 38 so that the user control knob will have a predetermined orientation relative to the shaft of control element 10.

Those skilled in the art will appreciate that the above-described retention system has numerous advantages over conventional retention systems that are currently used for attaching user control knobs to rotatable shafts. The system described in FIGS. 1-4 avoids the need to include set-screws for retaining a user control knob in place on a control shaft. In contrast to the prior art, this result is achieved without the need for customized control shaft designs. Accordingly, commercial, off-the shelf control element components with conventional D-shaped control shafts can be used with the retention system. The result is a significant reduction in costs associated with control element components.

A further advantage of the inventive arrangements is the enhanced mechanical support that the retention system provides for control shaft 14. Note that the insert 30 is firmly secured within the nut 20, which is mechanically supported by the case wall 15. Moreover, the insert 30 is disposed coaxial about the control shaft. With the foregoing configuration, the retention system provides enhanced structural support to the shaft 14. This additional structural support provides the shaft with a greater ability to withstand forces applied to the shaft in a direction transverse to the central axis 51. Accordingly, the shaft 14 is provided with improved resistance to damage caused by impacts and other applied forces.

The invention also concerns a method for retaining a knob on a rotatable shaft of a control element, using the retention system in FIGS. 1-4. Prior to beginning the process a collar and shaft of a control element can be pre-positioned in an opening 17 of a case wall 15 for an electronic device (not shown). Thereafter, the method can begin by positioning a cylindrically shaped insert 30 within a capture space 26 provided on a first end face 23*a* of a nut 20. This step can include guiding the insert through a gap in the wall 27 wall and sliding the insert in a direction transverse to the base central axis 29. The insert is inserted within the capture space to align the central D-shaped bore 38 of the insert with a central axis 29 defined by a threaded bore of the nut. As will be appreciated from the foregoing description of the retention system, a rotational displacement of the insert within the capture space will be thereafter facilitated by the inner surface 42 (an inner bearing surface) formed of wall 27. The method further includes limiting an axial movement of the insert within the capture space. This limitation upon axial movement is facilitated by the lip 24 and the end face 23*a* of the nut. In some embodiments, this limitation of axial movement can also involve disposing the friction control disk 40 between the flange 33 and the lip 24

After the insert has been positioned within the capture space, a rotatable shaft of a control element is inserted through the threaded bore of the nut and the D-shaped bore of the insert. The nut is then threaded onto the collar 12 of the control element 10. More particularly, the nut is threaded down onto the collar 12 until an end face 23*b* of the nut is securely engaged with a surface of a case wall 15. This step can be facilitated by engaging with a tool at least one of the notches 28 formed on the upper portion of the nut.

Once the nut 20 is securely threaded onto the collar 12, the method continues by urging the insert 30 (which is retained within the capture space 26) into the interior bore 58 of the user control knob 50. In some embodiments of the invention, this step can also include receiving at least one of the orientation flukes 36 within one of the slots 56 that are formed on the interior wall comprising the interior bore 58. More particularly, the orientation flukes can be used to align the control knob on the rotatable shaft 14.

The inner profile of the user control knob receives the insert in an insert cavity 57 and receives the nut within the nut cavity 52. The insert is urged into the inner bore of the user control knob until the retention barb 34 provided on the insert is engaged with the interlocking element 54. At this point, the user control knob 50 is removably secured to the insert and can function to rotatably actuate the rotatable shaft 14. More particularly, the user control knob can rotate about the nut 20 which is fixed to the collar 12, thereby actuating rotational movement of the shaft 14. If the friction control disk is used, the method can further comprise controlling a rotation resistance of the shaft by means of the friction control disk disposed between the insert and a portion of the nut.

In the event that the knob must be removed from the shaft 14 for any reason, a sufficient amount of axial force applied to the user control knob will disengage the interlocking element 54 from the retention barb 34, thereby releasing the user control knob from the shaft.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

We claim:

1. A knob retention system, comprising:

a nut which includes a base having a cylindrical shape including two opposing nut end faces, a threaded bore aligned with a base central axis, a wall extending transversely from a first one of said nut end faces, said wall defining an inner surface which comprises a circular arc coaxial with said central axis, said wall extending at least partially around a circumference of said base to define a capture space; and an insert rotatably retained within said capture space by said wall includes a body having a cylindrical shape, a retention barb disposed on an outer cylindrical surface of said insert which is configured for engaging an interlocking element formed on an interior bore of a user control knob, and a D-shaped bore extending along an insert central axis.

2. The knob retention system according to claim 1, further comprising a user control knob having an interior bore aligned with said base central axis and said insert central axis, said interior bore having an inner profile adapted for receiving said nut and said insert therein, and including an interior wall which defines said interlocking element for receiving said retention barb.

3. The knob retention system according to claim 2, wherein said insert further comprises one or more orientation flukes aligned around said insert central axis, and wherein said inner profile of said knob has a plurality of slots arranged to receive said orientation flukes.

4. The knob retention system according to claim 2, wherein said wall further comprises a retention lip disposed on said inner surface opposed from said fist nut end face and configured to limit a displacement of said insert within said capture space along direction aligned with said base central axis.

5. The knob retention system according to claim 4, wherein said insert further comprises a flange extending circumferentially around a periphery of said body.

6. The knob retention system according to claim 5, wherein said flange has a cylindrical surface configured to rotatably engage said inner surface of said wall.

7. The knob retention system according to claim 5, further comprising a friction control disk disposed between said flange and said lip.

8. The knob retention system according to claim 1, wherein said insert has at least one end face which comprises a bushing configured to rotatably engage said first nut end face when said insert is retained within said capture space.

9. The knob retention system according to claim 1, wherein said threaded bore of said nut is configured to engage a plurality of threads provided on a collar of a control element.

10. The knob retention system according to claim 1, wherein said nut includes a plurality of notches which form at least one castellation.

11. The knob retention system according to claim 1, wherein said wall extends less than an entire distance around said circumference of said base.

12. A knob retention system, comprising:

a nut which includes a base having a cylindrical shape including two opposing nut end faces, a threaded bore aligned with a base central axis, a wall extending from a first one of said nut end faces in a direction parallel to said central axis, said wall defining an inner surface which forms a circular arc coaxial with said central axis, said wall extending less than an entire circumference around said base to define a capture space; and an insert rotatably retained within said capture space by said wall includes a body having a cylindrical shape, a retention barb disposed on an outer cylindrical surface of said insert which is configured for engaging an interlocking element formed on an interior bore of a user control knob, and a D-shaped bore extending along an insert central axis;

a user control knob having an interior bore aligned with said base central axis and said insert central axis, said interior bore having an inner profile adapted for receiving said nut and said insert therein, and including an interior wall which defines an interlocking element for engaging said retention barb; and wherein said threaded bore of said nut is configured to engage a plurality of threads provided on a collar of a control element, and said D-shaped bore is configured to receive a rotatable shaft of said control element.

* * * * *